US006655311B1

(12) United States Patent
Martin et al.

(10) Patent No.: US 6,655,311 B1
(45) Date of Patent: Dec. 2, 2003

(54) MARINE SEISMIC DIVERTER WITH VORTEX GENERATORS

(75) Inventors: Daniel George Martin, Woodstock (CA); Mark S. Zajac, Katy, TX (US)

(73) Assignee: WesternGeco, L.L.C., Houston, TX (US)

( * ) Notice: Subject to any disclaimer, the term of this patent is extended or adjusted under 35 U.S.C. 154(b) by 0 days.

(21) Appl. No.: 10/180,913

(22) Filed: Jun. 26, 2002

(51) Int. Cl.[7] ..... B63B 21/56

(52) U.S. Cl. ..... 114/242; 114/246; 114/253

(58) Field of Search ..... 114/242, 244, 114/253; 244/1 TD; 367/22, 106

(56) References Cited

U.S. PATENT DOCUMENTS 4,729,333 A * 3/1988 Kirby et al. ..... 114/244
6,532,189 B2 * 3/2003 Barker ..... 367/17

* cited by examiner

*Primary Examiner*—Jesus D. Sotelo
(74) *Attorney, Agent, or Firm*—Moser, Patterson & Sheridan, L.L.P.

(57) ABSTRACT

The present invention provides methods, systems and apparatus for steering one or more cables towed through water by a vessel. In general, a diverter attached to the one or more cables may comprise a float, a vane extending from a bottom surface of the float, and one or more vortex generators disposed on a suction side surface of the vane. The one or more vortex generators may prevent stall of the diverter at high attack angles.

29 Claims, 4 Drawing Sheets

MARINE SEISMIC DIVERTER WITH VORTEX GENERATORS

BACKGROUND OF THE INVENTION

Field of the Invention

The present invention generally relates to the field of diverters used in marine seismic operations. More particularly, the present invention relates to diverters having vortex generators to prevent stall at high attack angles.

Marine seismic diverters control movement of seismic streamers and other equipment relative to a seismic tow vessel. As the tow vessel moves through the water, an array of one or more streamers and/or other equipment carrying cables are towed at a known velocity through the water. For multiple cables, diverters pull the cables outwardly from the vessel centerline to establish a separation among cables and maintain a width or "spread" for the streamer array.

Marine seismic diverters typically have wing shaped sections extending into the water (commonly referred to as "vanes") for urging the diverter and attached cable away from the seismic array centerline. The lateral displacement forces exerted by the vanes depend on the tow vessel speed, shape of the vane, and the angle at which the leading edge of the vane meets the oncoming flow of water (commonly referred to as the "attack angle"). For example, increasing the attack angle may increase the lateral displacement force proportionally and lead to an increased spread of the seismic array.

Increasing the spread of the seismic array may reduce seismic exploration costs by reducing a number of passes necessary to gather seismic data for a given area. Using relatively high attack angles, spreads of over one kilometer are achievable. However, if the attack angle becomes too great, the diverters may stop exerting lateral displacement forces and stall, which may result in a collapse of the spread, loss of cable separation, and, possible damage to the streamers, which may be extremely expensive to replace. Further, significant personnel time may be required to retrieve and re-deploy the streamer array resulting in costly delays in data gathering operations.

Accordingly, a need exists for a seismic diverter that avoids stall at high attack angles.

SUMMARY OF THE INVENTION

The present invention generally provides an apparatus, system, and method for deflecting one or more cables towed behind a vessel.

Embodiments of the apparatus comprise an attached or detached float with at least one vane shaped to move a cable in a selected direction as the vessel tows the cable through the water. One or more vortex generators are disposed on the vane to generate small vortexes within a boundary layer of laminar water flow across the vane to prevent boundary layer separation and the onset of stall at high attack angles. Some embodiments may comprise a controller capable of adjusting an attack angle of the diverter vane and/or a location of the vortex generators.

Embodiments of the system may comprise at least two such diverters attached to opposing outer cables of an array of cables towed behind a vessel. The diverters may provide opposing lateral forces for moving the opposing outer cables in opposing outer directions, creating a spread for the array. Embodiments of the method may comprise attaching the diverters to opposing outer cables and/or cables within the array and adjusting an attack angle of the diverters and/or a location of the vortex generators as the vessel tows the array of cables through the water.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiment of this invention and are therefore not to be considered limiting of its scope, for the invention may admit to other equally effective embodiments.

DETAILED DESCRIPTION OF THE PREFERRED EMBODIMENT

Figure 1:
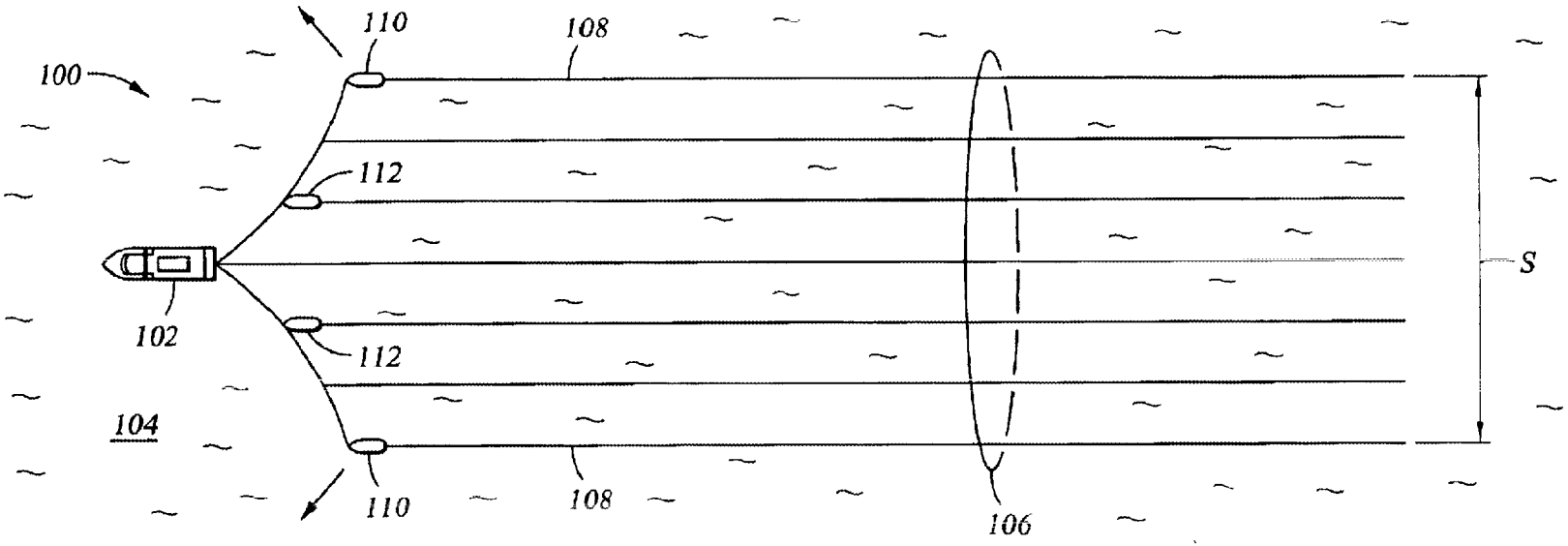
FIG. 1 illustrates a top view of an exemplary marine seismic system.

The present invention generally provides an apparatus, system, and method for steering one or more cables towed behind a vessel. For example, FIG. 1 illustrates an exemplary marine seismic system 100 comprising a tow vessel 102 deployed in water 104 to tow an array of cables 106. As used herein, the term "cable" may refer to seismic streamers, wires, conductors, and other structures for supporting floats, acoustic energy sources, hydrophones, positioning equipment, and other seismic equipment.

The array may comprise any suitable number of cables 106, each of any suitable length. For example, arrays of six and eight seismic streamers, each thousands of meters long, are well known in the art. An even number of streamers may advantageously provide space directly behind the tow vessel for towing other seismic equipment, such as seismic sources (air guns). For other embodiments, however, an odd number of cables may be used.

As illustrated, at least two diverters 110 may be attached to opposing outer cables 108 of the array to create a separation among cables 106. As the vessel tows the array of cables 106 through the water, the diverters 110 may provide outward lateral forces for moving the outer cables 108 in outward directions from a centerline of the array. For some embodiments, diverters 110 may create a distance, or "spread", between outer cables 108 of over one kilometer. Diverters 112 may also be attached to cables within the array of cables 106 to help maintain a spread of inner cables. The diverters 112 may be used instead of, or in addition to, the diverters 110. As illustrated, the diverters 110 and 112 may be attached to different locations along a cable to control a position of the cable within the array.

Figure 2:
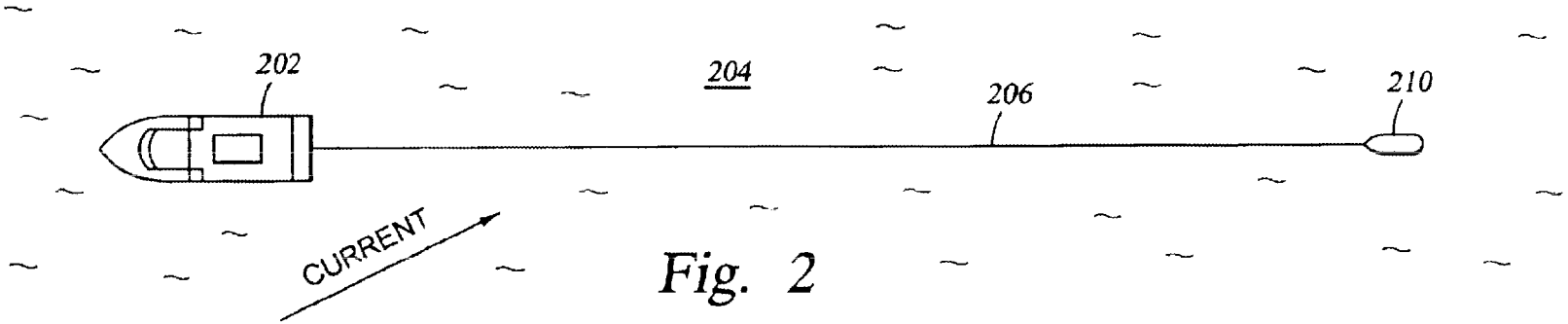
FIG. 2 illustrates a top view of another exemplary marine seismic system.

As illustrated in FIG. 2, for other embodiments, a single diverter 210 may be used to steer at least one cable 206 towed through water 204 behind a vessel 202. The diverter 210 may serve to keep the cable 206 (and attached equipment) centered behind the boat, for example, by offsetting the effects of a current. Alternatively, the diverter 210 may be attached to the cable 206 to pull one side of an array of seismic streamers away from a center point of the array.

Figure 3:
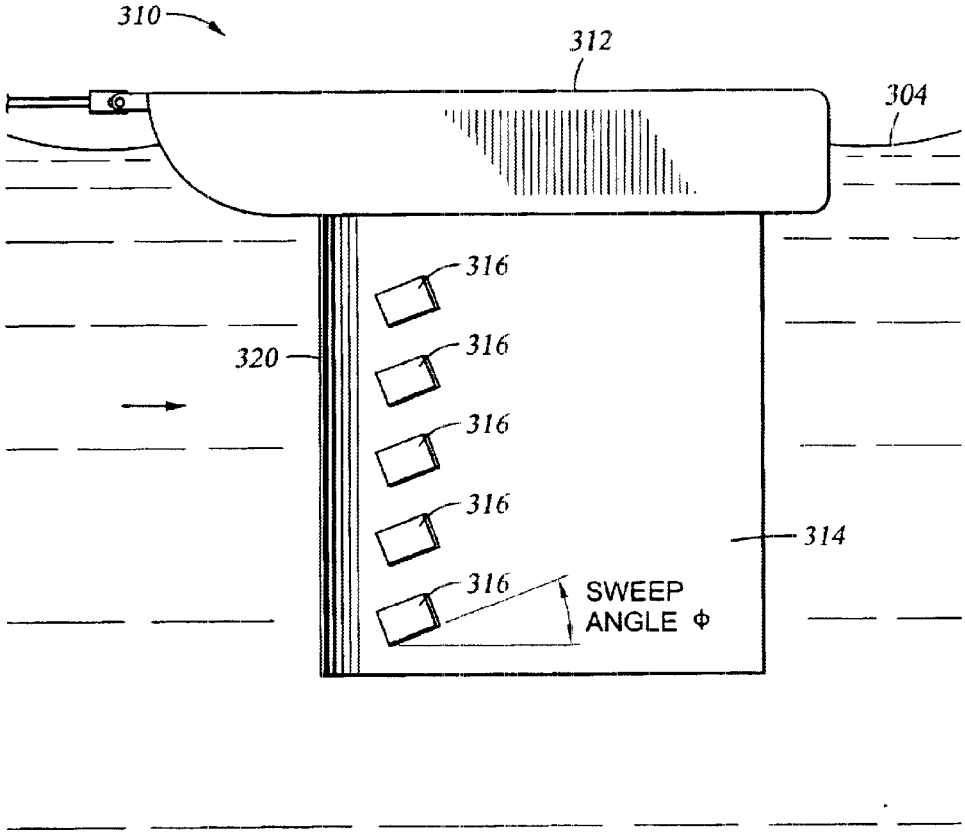
FIG. 3 illustrates a side view of an exemplary marine seismic diverter.

FIG. 3 illustrate a side view of an exemplary seismic diverter 310 according to one embodiment of the present invention. The seismic diverter 310 may comprise a float 312 with a vane 314 extending from, or suspended from, a bottom portion of the float 312. The float 312 may be any suitable shape and made of any suitable material, such as aluminum, fiberglass, plastic, steel, or a composite material. The vane 314 may also be any suitable material, and may be shaped to provide a lateral force for steering an attached cable as the cable and diverter are towed behind a vessel. The vane 314 may be made from the same material as the float or a different material.

Figure 4:
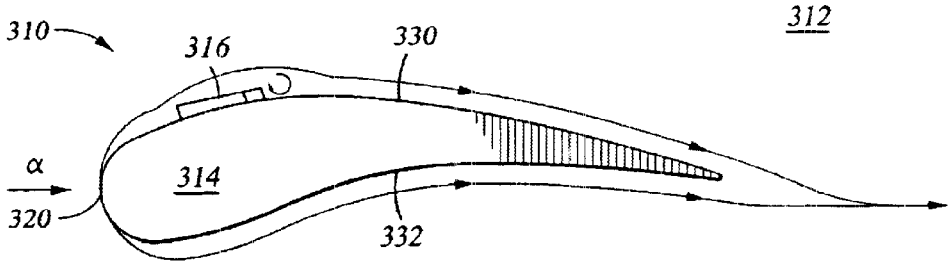
FIG. 4 illustrates a bottom view of the exemplary marine seismic diverter of FIG. 3.

The operation of the diverter 310 may be described with reference to the bottom view illustrated in FIG. 4. As a vessel tows the diverter 310, water may flow around the vane 314 in a manner similar to air flowing around an airplane wing. Water may flow faster along a suction side surface 330 than along a pressure side surface 332 which may create a pressure differential between the two surfaces, generating a lift generally perpendicular to the direction of the water flow (indicated by a straight arrow). As an angle a of a leading edge 320 of the vane with respect to the oncoming water flow, the attack angle, is increased, water may flow even faster along the suction side surface 330 of the vane creating an even greater pressure differential between the two surfaces and, hence, more lift.

As previously described, however, if the attack angle a is too great, the water flow may cease to follow the shape of the vane, and separate from the vane, resulting in a loss of lift (i.e. stall). In an effort to prevent stall, embodiments of the present invention may have one or more vortex generators 316 disposed on the suction surface side 330 of the vane 314. As the diverter 310 moves through the water, vortex generators 316 generate relatively small regions of turbulent flow (vortices), which may prevent separation of the layer of water flow. While typical attack angles are between 200 to 400, diverters of the present invention may be towed at attack angles up to and exceeding 500. Greater attack angles advantageously allow a greater array spread and, therefore, a greater seismic coverage area.

Vortex generators 316 may advantageously be located in proximity to the leading edge 320 of the vane 314 to prevent flow separation at an early location. The vortex generators 316 may be located in any suitable orientation on a suction side of the diverter vane 314. For example, as illustrated in FIG. 3, the vortex generators 316 may be located along a line substantially parallel to the leading edge 320. Alternatively, the vortex generators 316 may be located along a line at an angle with respect to the leading edge 320. Vortex generators 316 may be any suitable size and shape, and may be arranged in any suitable pattern. For some embodiments, vortex generators 316 may be generally rectangular in shape, extending up from the suction side surface 330 into the stream of flow. Examples of other suitable shapes include, but are not limited to, triangles, pyramids, and various U-shapes, such as horseshoes. As illustrated, vortex generators 316 may be oriented so that a lengthwise section is offset by a specified angle θ (commonly referred to as the "sweep angle") with respect to the oncoming flow of water to increase their effectiveness. An array of vortex generators 316 may include vortex generators set at different sweep angles.

The size, shape, and location of the vortex generators 316 may be optimized for a particular application by performing numerical analysis with a computational fluid dynamics (CFD) program, taking into consideration parameters such as towing speed, attack angle, the size and shape of the vane 314, desired cable separation, etc. Vortex generators 316 may be made of any suitable material, such as a sheet metal, or a plastic, such as a PVC material. For some embodiments, the vortex generators 316 may be made of a same material as the vane 314. For example, a molding process that forms the vane 314 may also form the vortex generators 316.

Figure 5:
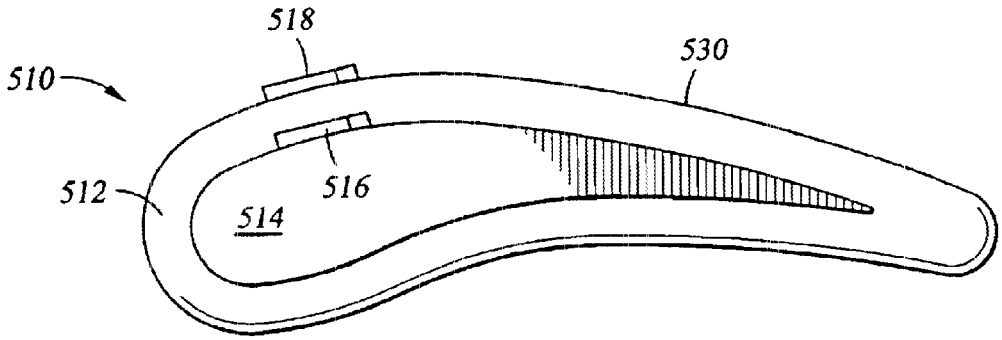
FIG. 5 illustrates a bottom view of another exemplary marine seismic diverter.

As a diverter vane moves through the water, a submerged portion of the diverter float is also moving through the water. As illustrated in FIG. 5, for some embodiments, a diverter 510 may comprise a float 512 shaped to provide a lateral force to steer an attached cable as the submerged portion of the float moves through the water as the vessel tows the diverter. Further, a bottom portion of the float 512 may have one or more vortex generators 518 disposed on a suction side surface 530 of the float 512. The vortex generators 518 may prevent the float 512 from stalling as it moves through the water, in a manner similar to that previously described with reference to vortex generators attached to the diverter vane. The float 512 typically has at least one vane 514 with a vortex generator 516 attached or extending from the suction side surface of the vane; the vane 514 extends from the bottom surface of the float 512.

Figure 6:
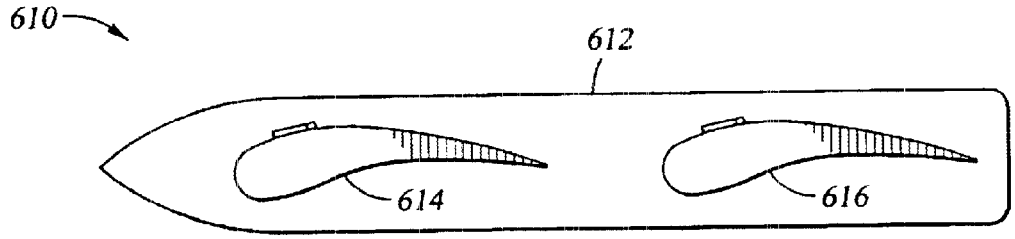
FIG. 6 illustrates a bottom view of an exemplary marine seismic diverter having a plurality of vanes.

Embodiments of the present invention are not limited to any number of vanes. FIG. 6 illustrates a bottom view of another exemplary seismic diverter 610 having a vane 614 and at least one additional vane 616. As illustrated, the additional vane 616 may be shaped substantially similar to the vane 614. Alternatively, the additional vane may be straight, for example, to provide stability as the diverter 610 moves through the water; the vanes 614 and 616 are attached to or extend from the bottom surface of a float 612. Vortex generators may be attached to just one, or any number, of the vanes.

For some embodiments of the present invention, one or more diverter vanes may comprise one or more sections moveable in relation to each other. For example, one or more movable sections may be collapsed to occupy a smaller area when storing the diverter, which may be advantageous on a tow vessel with a minimum amount of storage space. The one or more movable sections may then be expanded before or after deploying the diverter in the water.

Figure 7:
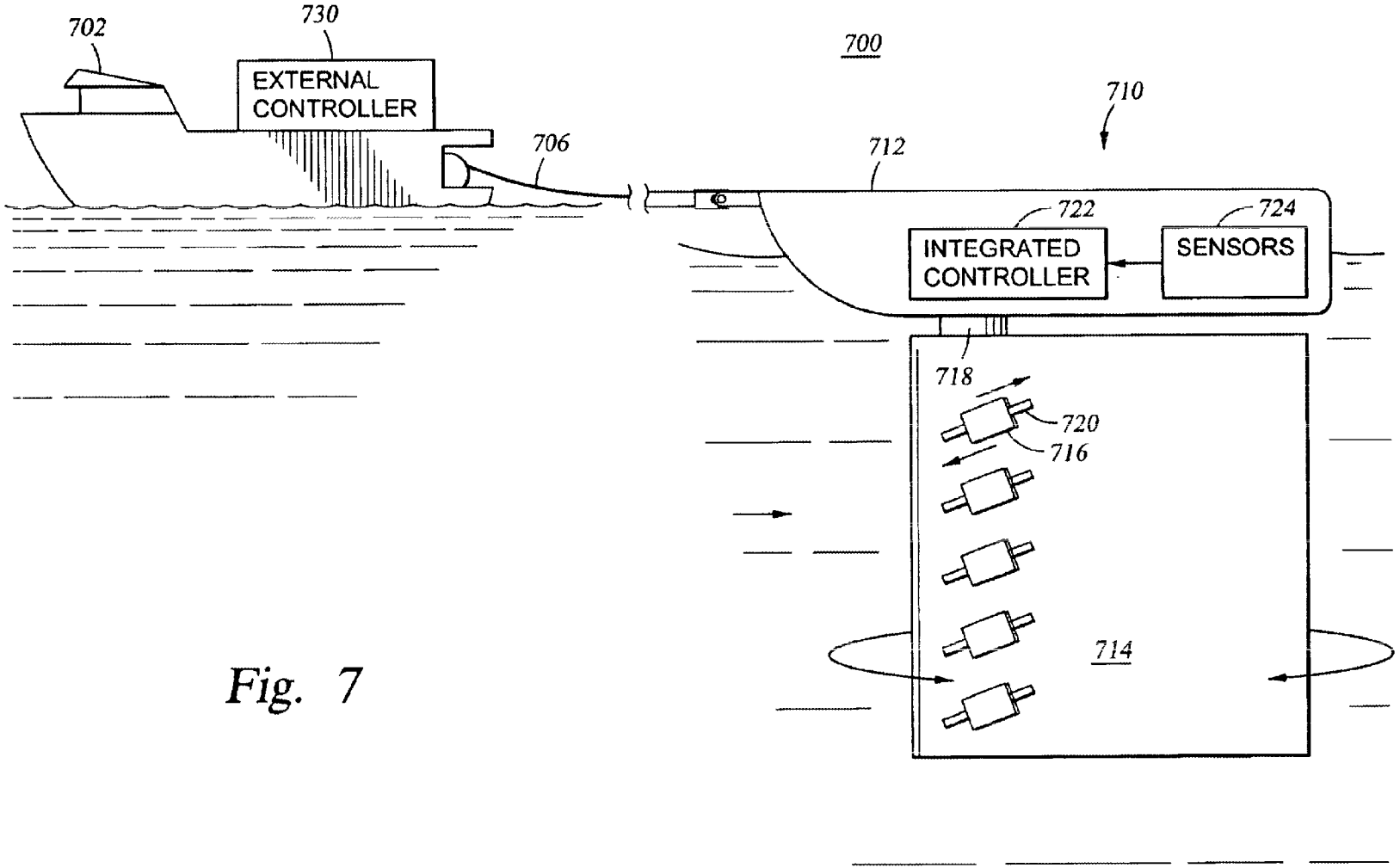
FIG. 7 illustrates an exemplary system comprising a seismic diverter having an integrated controller.

FIG. 7 illustrates an exemplary system 700 with a diverter 710 for steering a cable 706 behind a tow vessel 702. The diverter 710 has an integrated controller 722, which may be housed in a float 712, or incorporated within the vane. The integrated controller 722 may be capable of adjusting an attack angle of a vane 714, for example by rotating the vane 714 about an attachment point 718. The integrated controller 722 may also be capable of adjusting a location of one or more vortex generators 716, for example, to compensate for a change in attack angle or tow speed. To allow adjustment of the location of the vortex generators 716, the vane 714 may have slots 720 along which the vortex generators 716 may slide. However, other suitable techniques may also be used to adjust a location of vortex generators 716. For example, the vortex generators may be mounted on a movable structure attached to a surface of the suction side of the vane 714. Further, the sweep angle θ of any or all of the vortex generators may be adjustable by the controller.

For some embodiments, one or more sensors 724 may be coupled with the integrated controller 722, for example, to measure various parameters, such as tilt, camber, acceleration, speed, vibration and position. For some embodiments, position data may be provided by a global positioning system (GPS). The integrated controller 722 may communicate sensor data to an external controller.

For example, an external controller 730 located on a tow vessel 702 may be in communications with the integrated controller 722 to allow personnel to remotely steer the cable 706. For one embodiment, the external controller 730 may send control signals to the integrated controller 722 through control lines (not shown) located within the cable 706. Alternatively, the external controller 730 may communicate with the integrated controller 722 through a wireless connection, such as a radio frequency (RF) connection. For other embodiments, the external controller 730 may be placed at a location other than the tow vessel, such as a remote vessel carrying additional marine seismic equipment.

Figure 8:
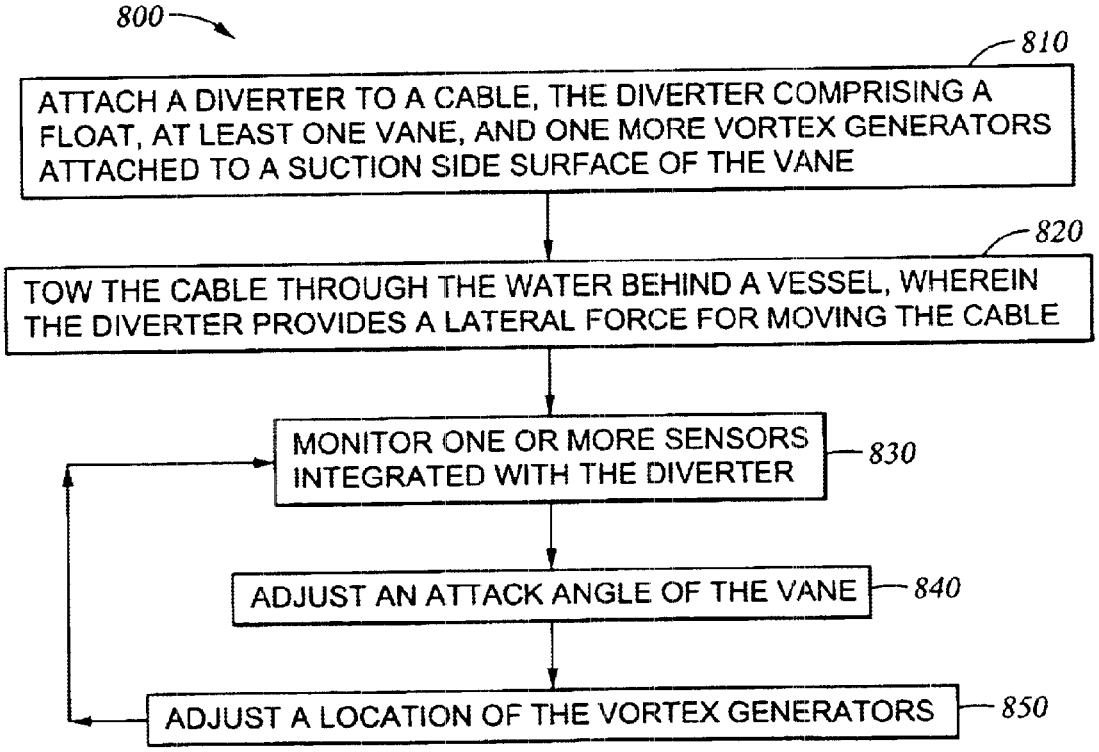
FIG. 8 is a flow diagram illustrating exemplary operations of a method for steering a cable towed through water behind a vessel.

FIG. 8 is a flow diagram 800 illustrating exemplary operations of a method for steering a cable towed through water behind a vessel. The operations of flow diagram 800 may be described with reference to the exemplary system of FIG. 7. However, it should be understood that other embodiments might also be capable of performing the operations of flow diagram 800.

For step 810, a diverter is attached to the cable, the diverter comprising a float, at least one vane, and one or more vortex generators attached to a suction side surface of the vane. For step 820, the cable is towed through the water behind the vessel, wherein the diverter provides a lateral force for moving the cable. For some embodiments, the cable 706 may be an outer cable of an array of cables, and the diverter 710 may steer the cable 706 in an outward direction to create a separation among cables of the array. As illustrated in FIG. 1, a diverter may also be attached to an opposing outside cable to steer the opposing outside cable in an opposing outward direction.

For step 830, one or more sensors integrated with the diverter are monitored. For some embodiments, the integrated controller 722 may gather sensor data from the sensors 724 and send the sensor data to the external controller 730. The external controller 730 may then process the sensor data, for example, to determine a status of the diverter 710. For example, the sensor data may indicate the diverter 710 is approaching a stall condition, is vibrating excessively, or is at risk of tipping over. This may be particularly important for applications where a seismic array may have a large spread and the diverter 710 may be too far from the vessel 702 for visual inspection by personnel.

For step 840, an attack angle of the diverter is adjusted. For example, if sensor data indicates the diverter 710 is approaching a stall condition, the attack angle may be decreased to avoid the stall condition. For step 850, a location of the vortex generators is adjusted, for example, to accommodate a change in attack angle or tow speed. For some embodiments, the external controller 730 may send control signals to the integrated controller 720 to adjust the attack angle of the vane 714 or adjust the location of the vortex generators 716. For other embodiments, the integrated controller 720 may adjust the attack angle of the vane 714 independently. As illustrated, steps 830 through 850 may be repeated continuously while towing the cable 706.

Embodiments of the present invention permit diverters to be operated at high angles of attack while avoiding stall. This feature of the invention is particularly useful in seismic operations where an array of seismic streamers with a large spread is used to gather data over a large area. As previously described, a large spread may reduce a number of passed needed to gather data for the area and may therefore reduce overall operating costs.

Although embodiments described herein refer to diverters with vanes having a generally vertical orientation for providing lateral forces, a diverter may be provided with a vane having a different orientation to accomplish different tow results. For example, a diverter with a vane having a generally horizontal orientation may be used to control an elevation of a towed cable and/or attached equipment. Accordingly, embodiments of the present invention may comprise vortex generators attached to a suction side surface of vanes having various orientations.

While the foregoing is directed to embodiments of the present invention, other and further embodiments of the invention may be devised without departing from the basic scope thereof, and the scope thereof is determined by the claims that follow.

What is claimed is:

1. An apparatus for steering a cable towed behind a vessel comprising:

a float having a top portion and a bottom portion;

at least one vane extending or suspended from the bottom portion of the float, the vane shaped to provide a force for moving the cable to a specified position relative to the vessel as the vessel tows the cable through the water; and one or more vortex generators disposed on a suction side surface of the vane.

2. The apparatus of claim 1, wherein the vortex generators are located along a line substantially parallel to a leading edge of the vane.

3. The apparatus of claim 1, wherein the vortex generators are substantially rectangular in shape.

4. The apparatus of claim 3, wherein lengthwise sections of the vortex generators are offset by a specified angle relative to the oncoming flow of water as the vessel tows the cable through the water.

5. The apparatus of claim 1, wherein a location of the vortex generators is adjustable.

6. The apparatus of claim 5, wherein the location of the vortex generators is adjustable by sliding each vortex generator within a slot formed in the suction side surface of the vane.

7. The apparatus of claim 1, further comprising a controller capable of adjusting an attack angle of the vane as the vessel tows the cable through the water.

8. The apparatus of claim 7, wherein the controller is capable of adjusting a location of the vortex generators as the vessel tows the cable through the water.

9. The apparatus of claim 1, wherein a bottom portion of the float is shaped to provide a force for moving the cable to a position relative to the vessel as the bottom portion of the float moves through the water as the vessel tows the cable through the water.

10. The apparatus of claim 9, comprising one or more vortex generators disposed on a suction side surface of the bottom portion of the float.

11. The apparatus of claim 1, comprising at least one additional vane extending or suspended from the bottom portion of the float.

12. A system for steering a cable towed through water behind a vessel comprising:

a diverter coupled with the cable, the diverter having a float, at least one vane extending or suspended from a bottom surface of the float, one or more vortex generators disposed on a suction side surface of the vane, and an integrated controller capable of adjusting an attack angle of the vane; and an external controller in communication with the integrated controller, the external controller capable of sending control signals to the integrated controller to adjust the attack angle of the vane.

13. The system of claim 12, wherein the integrated controller is capable of adjusting a location of the vortex generators.

14. The system of claim 12, wherein the external controller is located on the vessel.

15. The system of claim 14, wherein the external controller communicates with the integrated controller through control lines located within the cable.

16. The system of claim 12, wherein the integrated controller communicates global positioning system (GPS) data to the external controller.

17. A system for spreading an array of cables towed through water behind a vessel comprising:

at least two diverters to engage opposing outer cables of the array, each diverter having a float, at least one vane extending from a bottom portion of the float, and one or more vortex generators disposed on a suction side surface of the vane, wherein the vane of each diverter is shaped to provide a lateral force for moving a corresponding one of the outer cables in an outward direction from a centerline of the array.

18. The system of claim 17, wherein each diverter further comprises an integrated controller capable of adjusting an attack angle of the diverter vane as the vessel tows the array of cables through the water.

19. The system of claim 18, wherein the integrated controller is also capable of adjusting a location of the vortex generators.

20. The system of claim 19, wherein the integrated controller is capable of receiving control signals from an external controller.

21. A method for steering a cable towed through water behind a vessel, comprising:

attaching a diverter to the cable, the diverter comprising a float, a vane extending from a bottom surface of the float into the water, and one or more vortex generators disposed on a suction side surface of the vane; and towing the cable and attached diverter through the water, wherein the diverter provides a lateral force for moving the cable.

22. The method of claim 21, further comprising monitoring one or more sensors integrated within the diverter by a controller integrated within the diverter.

23. The method of claim 22, further comprising sending sensor information from the integrated controller to an external controller located on the vessel.

24. The method of claim 21, further comprising adjusting an attack angle of the vane as the vessel tows the array of cables through the water.

25. The method of claim 21, further comprising adjusting a location of the vortex generators as the vessel tows the array of cables through the water.

26. A method for spreading an array of cables towed through water behind a vessel, comprising:

attaching at least two diverters to opposing outer cables of the array, wherein each diverter comprises a float, a vane extending from a bottom surface of the float into the water, and one or more vortex generators disposed on a suction side surface of the vane; and towing the array of cables and attached diverters through the water, wherein the diverters steer the opposing outer cables in outward directions from a centerline of the array.

27. The method of claim 26, further comprising adjusting an attack angle of the vane of at least one of the diverters as the vessel tows the array of cables through the water.

28. The method of claim 26, further comprising adjusting a location of the vortex generators of at least one of the diverters as the vessel tows the array of cables through the water.

29. The method of claim 26, wherein adjusting an attack angle of the vane comprises sending control signals from an external controller to a controller integrated with the at least one diverter.

* * * * *